US006431960B1

(12) United States Patent
Walker et al.

(10) Patent No.: US 6,431,960 B1
(45) **Date of Patent: *Aug. 13, 2002**

(54) FIXED ABRASIVE POLISHING PAD

(75) Inventors: Michael A. Walker; Karl M. Robinson, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 44 days.

This patent is subject to a terminal disclaimer.

(21) Appl. No.: 09/593,046

(22) Filed: Jun. 12, 2000

Related U.S. Application Data

(62) Division of application No. 09/187,307, filed on Nov. 4, 1998, which is a continuation of application No. 08/917,018, filed on Aug. 22, 1997, now Pat. No. 5,919,082.

(51) Int. Cl.[7] ..... B24B 7/00

(52) U.S. Cl. ..... 451/41; 451/287; 451/529

(58) Field of Search ..... 451/41, 285, 286, 451/287, 288, 289, 526, 527, 529, 530, 539, 533

(56) References Cited

U.S. PATENT DOCUMENTS

| | | | | |
|---|---|---|---|---|
| 1,507,836 A | | 9/1924 | King | |
| 2,952,951 A | | 9/1960 | Simpson | |
| 5,212,910 A | | 5/1993 | Breivogel et al. | |
| 5,287,663 A | | 2/1994 | Pierce et al. | |
| 5,356,513 A | | 10/1994 | Burke et al. | |
| 5,421,769 A | | 6/1995 | Schultz et al. | |
| 5,435,772 A | | 7/1995 | Yu | |
| 5,441,598 A | | 8/1995 | Yu et al. | |
| 5,453,312 A | | 9/1995 | Haas et al. | |
| 5,468,682 A | | 11/1995 | Homma | |
| 5,503,592 A | | 4/1996 | Neumann | |
| 5,510,652 A | | 4/1996 | Burke et al. | |
| 5,516,400 A | | 5/1996 | Pasch et al. | |
| 5,516,729 A | | 5/1996 | Dawson et al. | |
| 5,525,191 A | | 6/1996 | Maniar et al. | |
| 5,527,424 A | | 6/1996 | Mullins | |
| 5,624,303 A | | 4/1997 | Robinson | |
| 5,725,417 A | | 3/1998 | Robinson | |
| 5,738,567 A | | 4/1998 | Manzonie et al. | |
| 5,769,699 A | | 6/1998 | Yu | |
| 5,919,082 A | * | 7/1999 | Walker et al. | 451/41 |
| 5,944,583 A | | 8/1999 | Cruz et al. | |
| 6,039,633 A | | 3/2000 | Chopra | |

* cited by examiner

*Primary Examiner*—Eileen P. Morgan
(74) *Attorney, Agent, or Firm*—Kirkpatrick & Lockhart LLP

(57) ABSTRACT

The present invention provides a method of limiting mechanical abrasion, that includes polishing a surface with a pad having a first member defining a first polishing surface and comprising a first material, and limiting abrasion of the surface with a surface abrasion impeding second member, the second member defining a second polishing surface and comprising a second material.

21 Claims, 3 Drawing Sheets

FIXED ABRASIVE POLISHING PAD

CROSS-REFERENCE TO RELATED APPLICATIONS

This application is a division of co-pending application Ser. No. 09/187,307, filed Nov. 4, 1998, which is a continuation of application Ser. No. 08/917,018, filed Aug. 22, 1997, now U.S. Pat. No. 5,919,082.

STATEMENT REGARDING FEDERALLY SPONSORED RESEARCH OR DEVELOPMENT

Not Applicable

BACKGROUND OF THE INVENTION

The present invention generally relates to mechanical polishing of a surface. More particularly, the present invention relates to composite fixed abrasive polishing pads and methods of use for mechanical polishing of the surface on a semiconductor substrate wafer.

Integrated circuits are typically constructed by depositing layers of predetermined materials to form circuit components on a wafer shaped semiconductor substrate. The formation of the circuit components in each layer generally produces a rough, or nonplanar, topography on the surface of the wafer. Nonplanar surfaces on the wafer can result in defects in subsequent circuit layers formed on the surface leading to flawed or improperly performing circuitry. Therefore, nonplanar surfaces must be made smooth, or planarized, to ensure a proper surface for the formation of subsequent layers of the integrated circuit.

Planarization of the outermost surface of the wafer is performed in two ways, locally over small regions of the wafers and globally over the entire surface. For example, a layer of oxide is typically deposited over the exposed circuit layer to provide an insulating layer for the circuit and to locally planarize regions by providing a continuous layer of material. A second layer of material is then deposited on top of the insulating layer to provide a surface that can be globally planarized without damaging the underlying circuitry. The second layer is generally composed of either an oxide or a polymer. Thick oxide layers can be deposited using conventional deposition techniques. Spin coating is a commonly used technique to form thick polymer layers on a wafer.

While deposition and spin coating techniques are useful in producing continuous uniform thickness layers, neither technique is particularly effective at producing a globally planar surface when applied to a nonplanar surface. As such, additional surface preparation is generally required prior to forming additional circuit layers on the wafer.

Other methods for globally planarizing the outermost surface of the wafer include chemical etching, press planarization and mechanical polishing, which includes chemical mechanical polishing, or planarization, (CMP). In chemical etching, the second layer is deposited over the preceding layers as described above and is chemically etched back to planarize the surface. The chemical etching technique is iterative in that following the etching step, if the surface was not sufficiently smooth, a new layer of polymer or oxide must be formed and subsequently etched back. This process is time consuming, lacks predictability due to its iterative nature, consumes significant amounts of oxides and/or polymers in the process, and generates significant amounts of waste products.

In global press planarization, a planar force is applied to press, or deform, the surface of the second layer to assume a planar topography. The obvious limitation to this technique is that a deformable material must be used to form the second layer.

Mechanical polishing of a surface is performed by mechanically abrading the surface generally with a polishing pad. Mechanical polishing can be performed either as a dry process (air lubricant) or a wet process (liquid lubricant).

In mechanical polishing, the wafer must be polished for a precise period of time to achieve a desired surface finish on the layer. If the wafer is not polished for a sufficient length of time, the desired finish will not be achieved. On the other hand, if the wafer is polished for a period of time longer than necessary, the continued polishing may begin to deteriorate the surface finish. The ability to control the time required to polish the surface of the wafer can greatly improve productivity by allowing for the automation of the process, increasing the yield of properly performing wafers, and reducing the number of quality control inspections necessary to maintain the process.

The size and concentration of the particles used to abrade the surface directly affects the resulting surface finish. If the particulate concentration is too low or the particle size too small, mechanical polishing will not proceed at a sufficient rate to achieve the desired polishing effect in the time provided. Conversely, if the particulate concentration is too high or the particles are too large, then the particulates will undesirably scratch the surface.

Polishing scratches are often a source of variability in the performance of the finished integrated circuit. Performance variability results from scratch induced problems, such as uneven interconnect metallization across a planarized surface and contamination effects due to the presence of voids formed or particles trapped in a layer as a result of the scratches.

In addition, mechanical polishing techniques often experience significant performance variations over time that further complicate the automated processing of the wafers. The degradation in performance is generally attributed to the changing characteristics of the polishing pad during processing. Changes in the polishing pad can result from particulates becoming lodged in or hardening on the surface of the pad, pad wear, or aging of the pad material.

Chemical mechanical polishing is a wet technique in which a chemically reactive polishing slurry is used in conjunction with a polishing pad to provide a synergistic combination of chemical reactions and wet mechanical abrasion to planarize the surface of the wafer. The polishing slurries used in the process are generally composed of an aqueous basic solution, such as aqueous potassium hydroxide (KOH), containing dispersed abrasive particles, such as silica or alumina. The polishing pads are typically composed of porous or fibrous materials, such as polyurethanes, that provide a relatively compliant surface in comparison to the wafer.

The benefits of performing both a chemical and a mechanical polishing of the surface are somewhat offset by the additional undesirable variations in the surface quality that can occur in CMP techniques. The additional variations generally result from imbalances that occur in the chemical and mechanical polishing rates. For example, if the chemical concentration is too low, the desired chemical reactions may not proceed at an appreciable enough rate to achieve the desired polishing effect. In contrast, if the chemical concentration is too high, etching of the surface may occur. Also, in CMP techniques, chemicals may become unevenly distributed in the pad resulting in further variations in the chemical polishing rate.

In addition, the chemicals that are needed to perform the CMP process are relatively expensive and are generally not recyclable. It is therefore desirable to minimize the amount of chemicals used in the process to reduce both the front end costs of purchasing and storing the chemicals and the back end costs of waste disposal.

Efforts have been made in the prior art to decrease the variability and increase the quality of the polish provided by CMP techniques. For instance, U.S. Pat. No. 5,421,769 to Schultz et al. discloses a noncircular polishing pad that attempts to compensate for uneven polishing that occurs as a result of the edges of the wafer traveling a greater distance across the polishing pad when a spinning polishing motion is used. U.S. Pat. No. 5,441,598 to Yu et al. discloses a polishing pad having a textured polishing surface that attempts to provide a surface that will more evenly polish wide and narrow depressions in the surface.

U.S. Pat. No. 5,287,663 to Pierce et al. discloses a polishing pad having a rigid layer opposite the polishing surface and a resilient layer adjacent to the rigid layer. The rigid layer imparts stability to the pad to prevent the unintended overpolishing, or dishing out, of material from between adjacent hard underlying features, while the resilient layer serves to redistribute any maldistribution of the polishing force. While the apparatuses and methods may provide a more planar surface by compensating for various features in the wafer, the inventions do not directly address the problem of overpolishing the wafer surface.

Other prior art efforts to minimize the uneven polishing of the wafer have focused on including additional material in the layers formed on the wafer to control overpolishing. U.S. Pat. Nos. 5,356,513 and 5,510,652 to Burke et al. and 5,516,729 to Dawson et al. all disclose the inclusion in the layers of additional material that is more or less susceptible to CMP than the material comprising the operative portion of the circuit.

The additional material included in the layer, known as a "polish stop", is used to prevent overpolishing of the wafer. However, polish stops do not overcome the problem of overpolishing, as discussed in the Dawson patent (col. 7, lines 18–59). Also, the procedures must be performed iteratively to obtain global planarization. The use of polish stops in the layer also increases the complexity of the manufacturing process and adds materials that are unnecessary to the end use of the circuit, both of which tend to increase the likelihood of flawed or improperly performing devices.

In view of these and other difficulties with prior art mechanical polishing techniques, there is a need for mechanical surface polishing methods and apparatuses that provide for a more generally applicable and predictable polishing technique.

BRIEF SUMMARY OF THE INVENTION

The present invention provides a method of limiting mechanical abrasion, that includes polishing a surface with a pad having a first member defining a first polishing surface and comprising a first material that is abrasive to the surface and structurally degradable during polishing, and limiting abrasion of the surface with a surface abrasion impeding second member, the second member defining a second polishing surface and comprising a second material that is less degradable and less abrasive than the first material.

In another embodiment, the present invention provides a method of limiting mechanical abrasion, that includes abrading the surface with a pad having a first member forming a polishing surface and comprising a first material that is abrasive to the surface and structurally degradable during abrading, and limiting abrasion of the surface with a surface abrasion impeding second member comprising a second material that is less degradable than the first material, the second member being removable to allow the first member to extend beyond the second member.

In yet another embodiment, the present invention provides a method of limiting mechanical abrasion, that includes polishing a surface with a pad having a first member defining a first polishing surface and comprising a first material that is abrasive to the surface and structurally degradable during polishing, and limiting abrasion of the surface with a surface abrasion impeding second member, the second member defining a second polishing surface and comprising a second material that is substantially nondegradable and nonabrasive, wherein the second material is more soluble in a solvent than the first material.

The applicant has found that the overall quality of the surface finish on the wafer can be increased and more tightly controlled by providing a precise amount of abrasive material effective to perform the polishing of the surface in a pad that prevents overpolishing of the surface. In this manner, problems associated with overpolishing and underpolishing of the surface can be minimized, unlike the methods and apparatuses of the prior art.

Accordingly, the apparatuses and methods of the present invention provide for increased reliability and performance in the mechanical polishing of surfaces, and specifically, chemical mechanical polishing of semiconductor wafer surfaces. The above advantages and others will become apparent from the following detailed description.

BRIEF DESCRIPTION OF THE DRAWINGS

Preferred embodiments of the present invention will be described in greater detail with reference to the accompanying drawings, wherein like members bear like reference numerals and wherein.

DETAILED DESCRIPTION OF THE INVENTION

Figure 1:
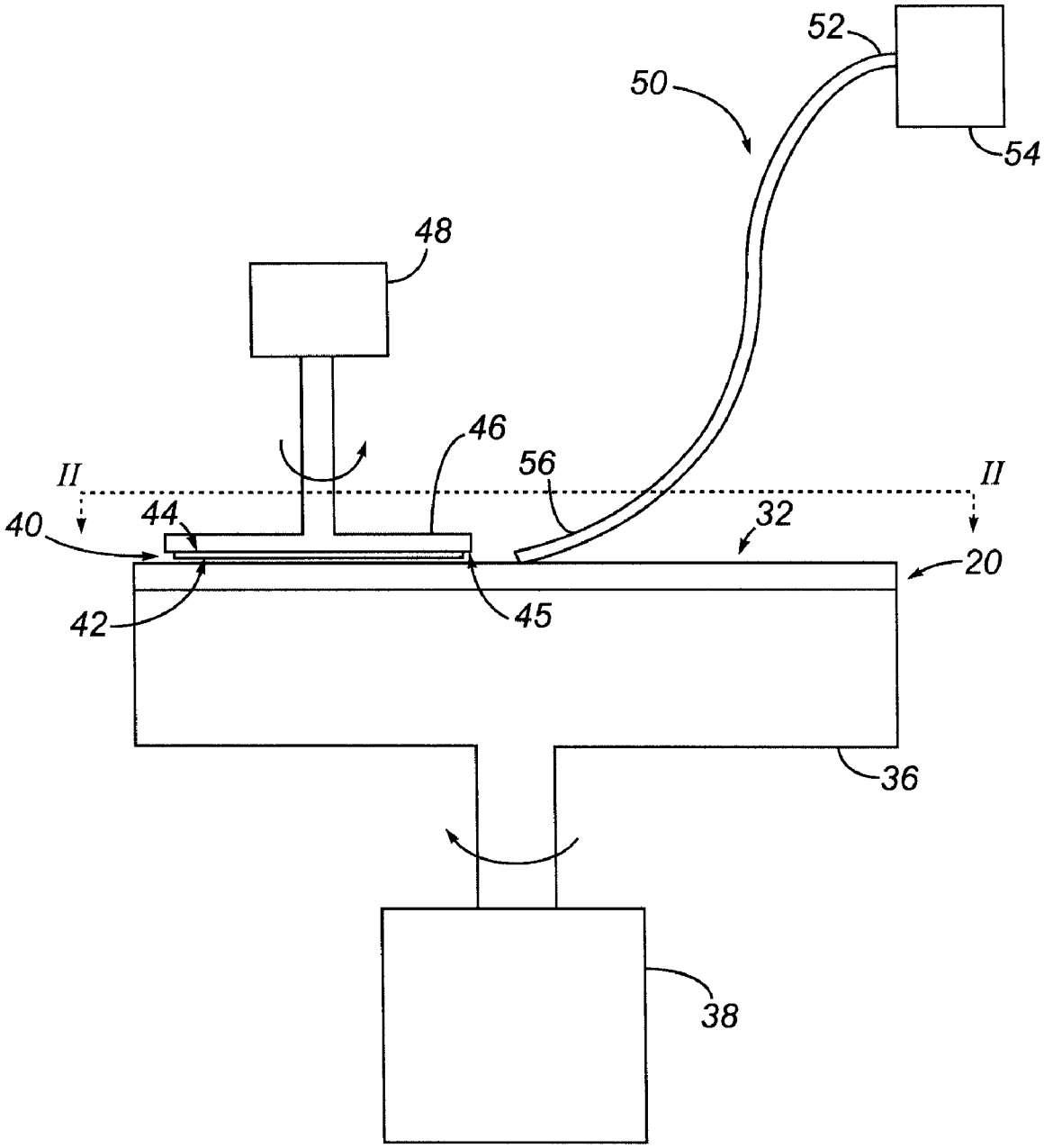
FIG. 1 is a side view of an apparatus of the present invention.
Figure 2:
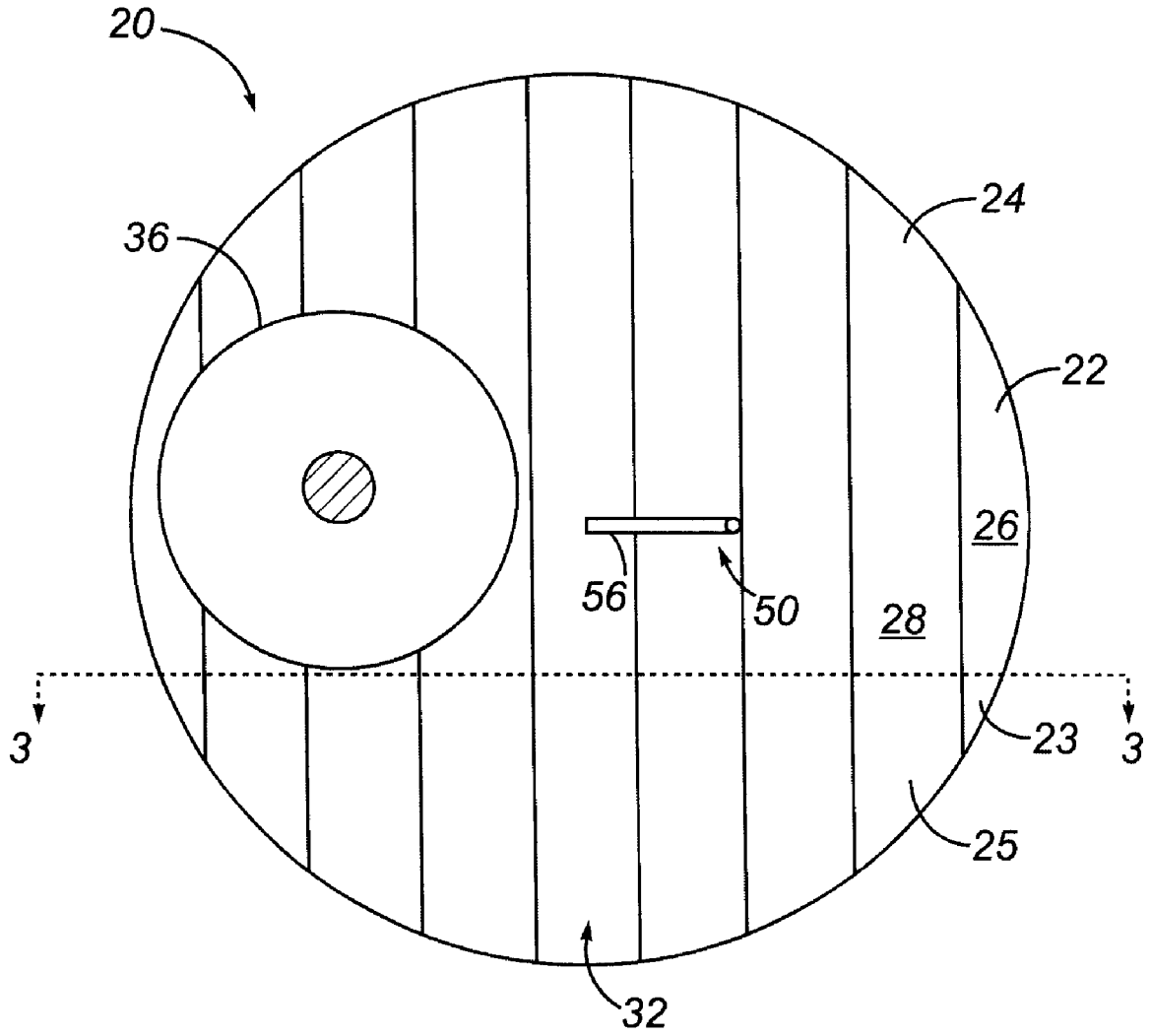
FIG. 2 is top cross sectional view of an apparatus along the line II—II of FIG. 1.

The operation of the apparatus 10 will be described generally with reference to the drawings for the purpose of illustrating present preferred embodiments of the invention only and not for purposes of limiting the same. As shown in FIGS. 1 and 2, the apparatus 10 of the present invention includes a polishing pad 20 for use in polishing a wafer 40.

The polishing pad 20 of the present invention includes at least a first member 22 and a second member 24 having first and second polishing surfaces, 26 and 28, respectively. The individual first and second polishing surfaces, 26 and 28, respectively, collectively define a polishing face 30 on the pad 20.

Preferably, as shown in FIGS. 2–5, a plurality of first and second sections, 23 and 25, respectively, are included in the first and second members, 22 and 24, respectively. The sections, 23 and 25, are arranged to provide alternating first and second polishing surfaces, 26 and 28, respectively, on the polishing face 30.

The first and second sections, 23 and 25, respectively, may be arranged in any geometrical shape, such as parallel rectangles or concentric circles, so as to optimize the orientation of the first and second members, 22 and 24, respectively, for a specific polishing application. For example, the sections can be arranged to minimize the differences in the amount of abrasive material contacted from the inside to the outside of the wafer as discussed in the Schultz patent. It will also be appreciated that additional members may be added to the pad 20 to provide intermediate degrees of polishing.

Figure 3:
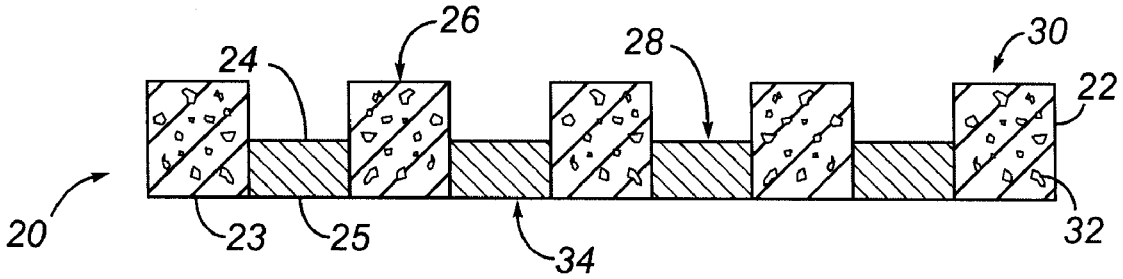
FIG. 3 is a cross section of a preferred embodiment of the present invention prior to polishing the surface of a wafer.
Figure 4:
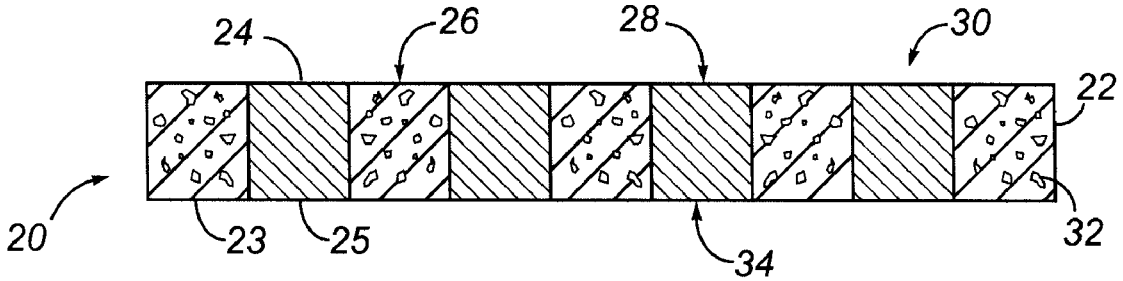
FIG. 4 is a cross section of a preferred embodiment of the present invention following the polishing the surface of a wafer; and, FIG. 5 is a cross section of an alternative preferred embodiment of the present invention prior to polishing the surface of a wafer.
Figure 5:
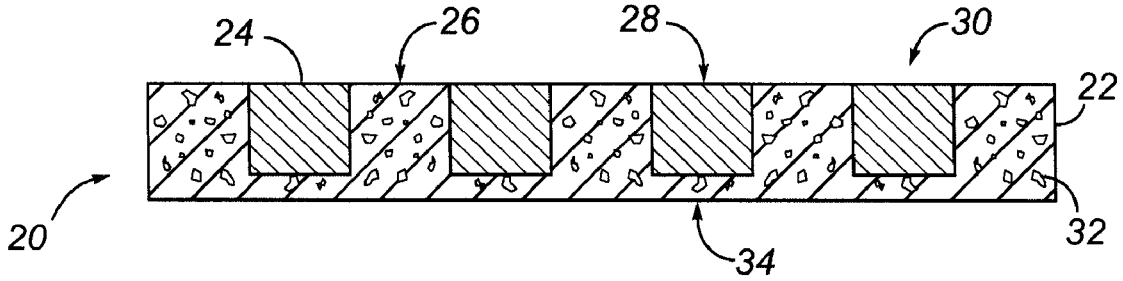

As shown in FIGS. 3 and 4, the first and second sections, 23 and 25, respectively, are discrete sections in the pad 20. Alternatively, as shown in FIG. 5, either the first member 22 or the second member 24 may be used as a matrix in which a plurality of sections of the other member are inset to form the pad 20. Also, the first and second members, 22 and 24, respectively, can be comprised of a common matrix material.

The first member 22 is formed from an abrasive material that is structurally degradable during the polishing of the wafer 40. Structurally degradable is meant to include all forms of degradation that result in a breakdown of the structure of the material including, but not limited to, wear, erosion, chemical dissolution, phase change and chemical breakdown of the material.

In a preferred embodiment, the first member 22 includes discrete particles of abrasive material 32 distributed throughout a substantially less abrasive matrix, as shown in FIGS. 3–5. Generally, oxide particles, such as $SiO_2$, $CeO_2$, $Al_2O_3$, $Ta_2O_5$, and $MnO_2$ are suitable for use as abrasive materials. In this embodiment, an abrasive or nonabrasive matrix material can also be used to form the first member 22.

The abrasive material 32 can be randomly distributed throughout the first member 22 or in any specific manner to achieve a particular purpose. For instance, the abrasive material can be loaded into the first member 22 such that larger particles will be exposed first and used for an initial rough polish of the wafer 40. The larger particles would then be followed by smaller particles that would provide for a fine polish of the surface of the wafer 40. Alternatively, the first member 22 can be formed from a material that is inherently abrasive, in addition to being erodible, thereby eliminating the need for discrete abrasive particles.

In a preferred embodiment, the second member 24 is formed from a second material that is substantially structurally nondegradable during polishing and substantially nonabrasive to provide a precise endpoint to the polishing process. The substantially nondegradable, nonabrasive characteristics of the material used for the second member 24 provide the ability to automate the polishing, because the second member does not substantially abrade the wafer 40. In this manner, the pad can be optimized for a set amount of abrasion relatively independent of the polishing time. For example, once the desired amount of abrasive has been worn from the first member 22, the second member 24 will contact the wafer 40 and substantially reduce or stop further abrasion of the wafer 40. Therefore, the timing of the process will not be as crucial to the overall quality of the surface finish and performance of the integrated circuit.

The second member 24 can alternatively be a second material that is less structurally degradable and/or less abrasive than the first member 22. As such, the second member should not generally degrade to an extent during polishing that additional abrasive material in the first member 22 is exposed to the surface and should generally produce less severe abrasions of the surface than the first member 22. Preferably, the second material is substantially less structurally degradable and substantially less abrasive, for example, by at least an order of magnitude, than the first member 22. A substantial difference in the degradability and abrasiveness between the members, 22 and 24, is desirable to ensure that the second member is sufficiently less degradable and abrasive so as to limit the amount of the first member available to abrade the surface, such as to an effective amount to perform the desired polishing, and to provide flexibility in the use of the pad 20 from a processing standpoint.

The embodiments including a less abrasive second member 24 may be useful to perform a final polish of the wafer 40, analogous to the preceding discussion regarding the alignment of the particles in the first member 22. The fine polishing of the wafer 40 may be desirable as a practical matter, because the first member 22 may not ideally degrade in all practical applications and a fine polishing second member may provide for a more consistent surface finish. Also, if the first member 22 and the second member 24 are formed from a common matrix material, the first member 22 can be made to be more abrasive than the second member 24 by inclusion of abrasive material in the matrix or by selective chemical treatment of the matrix material.

Suitable materials for use in the present invention are described, for example, in U.S. Pat. No. 5,624,303 issued to Robinson and U.S. patent application Ser. No. 08/743,861, which are incorporated herein by reference.

In practice, a portion of the second member 24 is removed from the pad 20 so that a portion of the first member 22 containing the first polishing surface 26 extends beyond the second polishing surface 28, as shown in FIG. 3. The amount of the second member 22 that is removed can be controlled so that only an effective amount of the first member 22 is exposed to provide the desired polishing operation. The second member 24 can be removed either mechanically or chemically, such as described in U.S. patent application Ser. No. 08/743,861.

The polishing pad 20 can be employed in any number of polishing apparatuses, one embodiment of which is shown in FIGS. 1 and 2 and described herein. The polishing pad 20 has an opposing surface 34 that can be attached to a platen 36. The platen 36 can be attached to a platen motor 38 to impart a polishing motion to the platen 36 or the platen can be stationery. Commercially available platens 36 and platen motors 38 can be used in the present invention.

The wafer 40 has a device surface 42 that is to be polished and a back surface 44 that is seated on a support surface 45 of a wafer support 46. The wafer support 46 is brought into close proximity with the polishing face 30. The device surface 42 of the wafer 40 is positioned parallel to and brought into contact with the polishing face 30 either directly or via the liquid lubricant and/or the abrasive particles.

The wafer support 46 and the polishing pad 20 are placed in relative motion to effect the polishing of the device surface 42. The wafer support 46 can be moved in a polishing motion using a motor 48 or can remain stationary with the polishing motion provided by the polishing pad 20. One skilled in the art will appreciate that the pad 20 and the wafer support 46 can be moved in a variety of motions, such as rotational, translation or orbital, to polish the wafer surface 42.

In wet mechanical polishing applications, a liquid dispense line 50 is provided that has a source end 52 attached to a liquid, or slurry, source 54 and a dispense end 56. The dispense end 56 is positioned to dispense the liquid or slurry between the polishing pad 20 and the wafer 40. The dispense end 56 can also be integral with the polishing pad 20 and the liquid can be dispensed through porous regions in the first and second members. The dispense line 50 can be constructed from polyethylene or other materials as is known in the art. The liquid or slurry is transported from the liquid source 54 through the dispense line 50 by conventional means, such as a pump (not shown).

A liquid or slurry can be used with the pad 20 as a lubricant for wet mechanical polishing of the surface and to flush the polishing surface to prevent the buildup of particles during the polishing process. A chemically active liquid lubricant can also be selected that forms a reactive slurry in situ with the particles that are released as the first member 22, in addition to serving as a lubricant for the polishing pad 20.

The particular liquids or slurries used depend upon the surface to be polished and the type of polishing pad used. For example, deionized water can be used as a lubricant in wet mechanical polishing or reactive slurries, such as aqueous potassium hydroxide (KOH) containing $SiO_2$ particles, can be employed during chemical mechanical polishing of the surface.

The polishing pad 20 will be further described with respect to chemical mechanical polishing as an exemplary implementation of the present invention. The first member 22 is preferably comprised of a material that is erodible or dissolves in the presence of polishing chemicals used in the polishing technique.

Generally, the abrasive material 32 employed in the first member 22 is unaffected by the polishing chemicals. However, an abrasive material can be used that is either soluble or breaks down in the polishing chemicals. In this way, the abrasive material will remain abrasive for only a finite period of time and will not embed in the pad 20 and affect the polishing characteristics of the pad. Also, a chemically active first material can be selected for the first member 22 that when solvated in the polishing chemicals can vary that the polishing chemical strength with the amount of polishing and the resultant degradation of the first member 22.

The second member 24 is preferably comprised of materials that are substantially less erodible or soluble in the polishing chemicals, for example, by at least an order of magnitude, in addition to being substantially less abrasive to the surface that is to be polished than the first member 22. Preferably, a material used for the second member 24 that can be easily removed from the pad 20, such as by chemical stripping or etching, to expose the first polishing surface 26 and a portion of the first member 22 that contains an amount of abrasive material to perform the desired amount of polishing.

The materials selected for the first and second members, 22 and 24, respectively, depend upon the composition of the wafer surface to be polished and the polishing chemicals to be used. For example, polyurethanes and polyphenyl oxides can be used to form the first member 22, polyacrylates and polymethylmethacrylates can be used to form the second member 24 and $HCl/H_2O$ solutions can used as solvents, or stripping chemicals. As a further example, polyimides and acetal resins can be used to form the first member 22, with urethanes and polyacrylates can be used to form the second member, in conjunction with acetone or isopropyl alcohol solvents.

The operation of the apparatus 10 will be described with respect to the use of the pad 20 in a CMP process to polish the surface of a silicon dioxide ($SiO_2$) layer on a semiconductor wafer. The first member 22 of the pad 20 is formed from polyurethane and contains 15 nm–1,000 nm particles of silica distributed throughout. The second member 24 is formed from an acrylate polymer. Prior to polishing, the polishing pad has an appearance similar to that shown in FIGS. 4 and 5.

A mild solution of hydrochloric acid (HCl) (<1 M) is used to strip, or etch back, the second member 24. The HCl reacts with the acrylate polymers to form water soluble polyacrylic acids that are rinsed from the surface of the second member 24 using deionized (DI) water. The acrylate polymer is stripped to expose the precise amount of the first member 22 necessary to perform the desired amount of polishing. The pad 20 at this time has an appearance similar to that shown in FIG. 3.

The pad 20 is attached to the platen 36 and a wafer is attached to the wafer support 46. The wafer support 46 is brought sufficiently close to the polishing pad 20 to affect the polishing operation by placing the wafer device surface 42 in contact with the first member 22, either directly or via polishing chemicals or the abrasive material 32. The polishing chemicals are dispensed between the wafer device surface 42 and the first polishing surface 26 and the polishing pad 20. Relative motion, such as rotational, translation or orbital, is provided between the device surface 42 and the first polishing surface 26. The polishing is performed for a predetermined period of time corresponding to at least the time required for the first member 22 to structurally degrade and become flush with the second member 24.

When the first polishing face 26 becomes substantially flush with the second polishing face 28, the contact of the second member 24 with the surface 42 will substantially reduce or prevent further abrasion to the device surface 42 by the first member 22. The polishing pad 20 will again have an appearance similar to that shown in FIGS. 4 and 5. The polishing pad 20 can be reconditioned to perform additional polishing by removing another portion of the second member 24 to further expose the first member 22 for use in polishing additional surfaces or by other methods, such as those described in the Robinson patent.

The polishing pad of the present invention can be used in conjunction with the various modified pad designs described in the background to provide additional features in the pad. One skilled in the art can suitably modify the pad for use with various polishing apparatuses known in the art.

The present invention provides the ability to control the amount of abrasive material exposed to a surface during a mechanical polishing operation. The control afforded by the present invention allows for more automation and less monitoring of the polishing process than was possible with the prior art. While the subject invention provides these and other advantages over the prior art, it will be understood, however, that various changes in the details, materials and arrangements of parts and steps which have been herein described and illustrated in order to explain the nature of the invention may be made by those skilled in the art within the principle and scope of the invention as expressed in the appended claims.

What is claimed is:

1. A method of limiting mechanical abrasion, comprising:

polishing a surface with a pad having a first member defining a first polishing surface and comprising a first material that is abrasive to the surface and structurally degradable during polishing; and limiting abrasion of the surface with a surface abrasion impeding second member, the second member defining a second polishing surface and comprising a second material that is less degradable and less abrasive than the first material.

2. The method of claim 1, further comprising removing a portion of the second member to expose an amount of the first member effective to polish the surface.

3. The method of claim 2, wherein the second member is more soluble in a solvent than the first material, and said removing further comprises removing a portion of the second member using the solvent.

4. The method of claim 2, wherein said removing includes chemically stripping the second member.

5. The method of claim 2, wherein said removing includes mechanically stripping the second member .

6. The method of claim 1, wherein said pad further comprises:

said first member includes a plurality of first sections having first polishing surfaces; and, said second member includes a plurality of second sections having second polishing surfaces that with said first polishing surfaces define a polishing face.

7. The method of claim 6, wherein the plurality of first sections and second sections are provided in an alternating arrangement.

8. The method of claim 1, wherein:

the second material comprises an acrylate polymer; and, the first material comprises a urethane material containing discrete abrasive particles ranging from 15 nm–1000 nm in size and selected from the group consisting of $SiO_2$, $CeO_2$, $Al_2O_3$, $Ta_2O$, and $MnO_2$.

9. The method of claim 8, wherein the abrasive particles are in a specific order such that larger particles are located closer to the polishing surface and smaller particles are located further from the polishing surface.

10. The method of claim 1, further comprising a pad having an intermediate member defining an intermediate polishing surface and comprising an intermediate material that is abrasive to the surface and structurally degradable during polishing.

11. The method of claim 1, further comprising providing liquid on the surface during said polishing.

12. A method of limiting mechanical abrasion, comprising:

abrading the surface with a pad having a first member forming a polishing surface and comprising a first material that is abrasive to the surface and structurally degradable during abrading; and limiting abrasion of the surface with a surface abrasion impeding second member comprising a second material that is less degradable than the first material, said second member being removable to allow said first member to extend beyond said second member.

13. The method of claim 12, wherein said abrading further comprises polishing the surface with the first member until the second member contacts the surface.

14. The method of claim 2, wherein the second material is more soluble in a solvent than the first material.

15. The method of claim 4, further comprising removing a portion of the second member to expose an amount of the first member effective to polish the surface.

16. The method of claim 2, wherein the second material is substantially nonerodible.

17. The method of claim 2, wherein the second material is substantially nonabrasive.

18. A method of limiting mechanical abrasion, comprising:

polishing a surface with a pad having a first member defining a first polishing surface and comprising a first material that is abrasive to the surface and structurally degradable during polishing; and limiting abrasion of the surface with a surface abrasion impeding second member, the second member defining a second polishing surface and comprising a second material that is substantially nondegradable and nonabrasive, wherein the second material is more soluble in a solvent than the first material, said second member being removable to allow said first member to extend beyond said second member.

19. The method of claim 18, wherein the first and second members are comprised of a common matrix material.

20. The method of claim 18, wherein the first material comprises discrete abrasive particles ranging from 15 nm–1000 nm in size and selected from the group consisting of $SiO_2$, $CeO_2$, $Al_2O_3$, $Ta_2O_5$, and $MnO_2$.

21. The method of claim 20, wherein said abrasive particles are structurally degradable during the polishing of the wafer.

* * * * *

UNITED STATES PATENT AND TRADEMARK OFFICE

CERTIFICATE OF CORRECTION

PATENT NO. : 6,431,960 B1 
DATED : August 13, 2002
INVENTOR(S) : Walker et al.

It is certified that error appears in the above-identified patent and that said Letters Patent is hereby corrected as shown below:

Column 9,
Line 5, add the following language to the end of Claim 1, after the word "material".
-- said second member being removable to allow said first member to extend beyond said second member --.

Signed and Sealed this

Seventh Day of January, 2003

JAMES E. ROGAN
*Director of the United States Patent and Trademark Office*